US006892039B2

(12) United States Patent
Okamoto et al.

(10) Patent No.: US 6,892,039 B2
(45) Date of Patent: May 10, 2005

(54) CONNECTOR HAVING A BUILT-IN MEMORY IC MOUNTED ON A DEVELOPMENT CARTRIDGE

(75) Inventors: Katsumi Okamoto, Nagano-Ken (JP); Junji Shirokoshi, Nagano-Ken (JP); Takeshi Aoki, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 4 days.

(21) Appl. No.: 10/367,968

(22) Filed: Feb. 19, 2003

(65) Prior Publication Data

US 2003/0170042 A1 Sep. 11, 2003

(30) Foreign Application Priority Data

| | | |
|---|---|---|
| Feb. 19, 2002 | (JP) | 2002-041139 |
| Feb. 19, 2002 | (JP) | 2002-041140 |
| Feb. 20, 2002 | (JP) | 2002-042877 |
| Mar. 4, 2002 | (JP) | 2002-057178 |

(51) Int. Cl.[7] ..... G03G 15/00; H01R 13/62; H01R 24/00

(52) U.S. Cl. ..... 399/90; 399/119; 439/326; 439/630

(58) Field of Search ..... 399/90, 111, 119; 439/326, 630

(56) References Cited

U.S. PATENT DOCUMENTS

| | | | | |
|---|---|---|---|---|
| 4,222,622 A | | 9/1980 | Griffin et al. | |
| 4,903,167 A | | 2/1990 | Lichtensperger | |
| 5,907,748 A | * | 5/1999 | Kawana | 399/90 |
| 5,963,759 A | * | 10/1999 | Kojima et al. | 399/111 |
| 5,980,294 A | * | 11/1999 | Kanda et al. | 439/326 |
| 6,014,533 A | | 1/2000 | Kawana | |
| 6,056,573 A | * | 5/2000 | Nishioka | 439/630 |
| 6,238,248 B1 | * | 5/2001 | Ogura et al. | 439/630 |
| 6,349,182 B2 | * | 2/2002 | Otsubo et al. | 399/90 |

FOREIGN PATENT DOCUMENTS

| | | |
|---|---|---|
| EP | 0 813 356 A | 12/1997 |
| EP | 0 821 445 A | 1/1998 |
| EP | 0 822 469 A | 2/1998 |
| EP | 0 913 745 A | 5/1999 |

* cited by examiner

*Primary Examiner*—Susan Lee
(74) *Attorney, Agent, or Firm*—Sughrue Mion, PLLC

(57) ABSTRACT

A connector with a built-in memory IC which is mounted on a rotary development unit of a printer. The memory IC substrate is disposed within a contact protecting member and behind the rear side of an impact receiving member. A first electric contact is disposed on the front side of the impact receiving member and is connected to a second electric contact via a conductive member. The second electric contact spring contacts the memory IC substrate. The connector contains guide members to help stabilize the connection between the connector and the body side connector of the printer.

12 Claims, 8 Drawing Sheets

CONNECTOR HAVING A BUILT-IN MEMORY IC MOUNTED ON A DEVELOPMENT CARTRIDGE

BACKGROUND OF THE INVENTION

The present invention relates to a connector with a built-in memory IC for reading/writing data such as consumption of toner, to a development cartridge having such a connector, and to an image forming apparatus using such a development cartridge.

In image forming apparatuses such as printers, a memory IC is mounted on a development cartridge. By connecting the memory IC to an apparatus body-side connector, data such as information about remaining amounts of respective color toners, cartridge freshness information about whether the present cartridge is new or old, cartridge placing information for informing the apparatus body whether a cartridge is placed or not, conditions about image formation such as development bias, and recycle information about how many times a cartridge is exchanged, are written. When the development cartridge is placed, the history information is read out from the memory IC so that the information can be recognized on the apparatus body side.

In this case, for example in a cartridge of an inkjet printer, a memory IC substrate in which history information is written is connected to a connector by crimping electric wires or a memory IC substrate is soldered to terminals of a connector.

Conventionally, a memory IC to be mounted to a development cartridge comes in contact with an apparatus body-side connector so that mechanical force is directly applied to the memory IC when data is read/written. Therefore, the life of contacts of the memory IC is short. In addition, since high voltage is applied to the development roller, contact members are susceptible to field noise due to the effect of the applied voltage so that malfunction easily occurs due to static electricity and/or toner stains. Therefore, the protection of the memory IC and the stability of contacts are not enough ensured.

In case that the terminals of memory IC substrate are connected to the connector by crimping electric wires, inferior contact such as insufficient crimping and breakage of the wires may occur. In case that the memory IC substrate is soldered to the terminals of the connector, inferior contact may be occur due to bad soldering and there is another problem that when the memory IC substrate is reused, the memory IC substrate should be removed by heating so that even if it can be removed, information stored in the memory IC may be broken due to heat. Longer contact member is particularly susceptible to field noise because it serves as an antenna.

SUMMERY OF THE INVENTION

It is an object of the present invention to ensure the stability of contacts of a connector with a built-in memory IC and thus to improve the reliability.

It is another object of the present invention to ensure the stability of contacts of a connector with a built-in memory IC and thus to improve the reliability.

It is another object of the present invention to ensure the stability of contacts by avoiding the occurrence of inferior contact, and to make a memory IC substrate detachable so that the memory IC is reusable.

It is still another object of the present invention to make a memory IC substrate detachable and also stabilize the mounted state of the memory IC substrate.

Therefore, the first invention is a connector with a built-in memory IC which is mounted in a rotary development unit and of which data is read and written by bringing an apparatus body-side connector to be connected with and spaced apart form said connector, and comprises an impact receiving member; a first electric contact which is disposed on the front side of the impact receiving member; a memory IC substrate which is disposed on and apart from the rear side of the impact receiving member; and a second electric contact which is configured by bringing a conductive member extending from the first electric contact into contact with a terminal of the memory IC substrate.

The second invention is a connector with a built-in memory IC which is mounted in a rotary development unit and of which data is read and written by bringing an apparatus body-side connector to be connected with and spaced apart form said connector, and comprises a plurality of contact members; a guide member(s) which is formed with the contact members; an impact receiving member being provided on one surface thereof with said guide member; and a contact protecting member which is disposed on the other surface of the impact receiving member and encompasses a memory IC substrate.

The third invention is a connector to which a memory IC substrate is detachably attached and which comprises conductive members having connecting terminals relative to an apparatus body-side connector and connecting terminals relative to the memory IC substrate, wherein the connecting terminals of said conductive members relative to the memory IC substrate have elasticity.

The fourth invention is a connector comprising a positioning mount portion which is engaged with a front end of a memory IC substrate and a hook portion for engaging a rear end of the memory IC substrate and having contacts which are in contact with terminals of the memory IC substrate by spring force in the state that the memory IC substrate is detachably installed to the connector, wherein said contacts are aligned in a plurality of lines and, among said contacts, a contact at the center side of a substrate is set to have a spring load higher than the other contacts.

DESCRIPTION OF THE PREFERRED EMBODIMENTS

Hereinafter, an embodiment of the present invention will be described with reference to the attached drawings.

Figure 1:
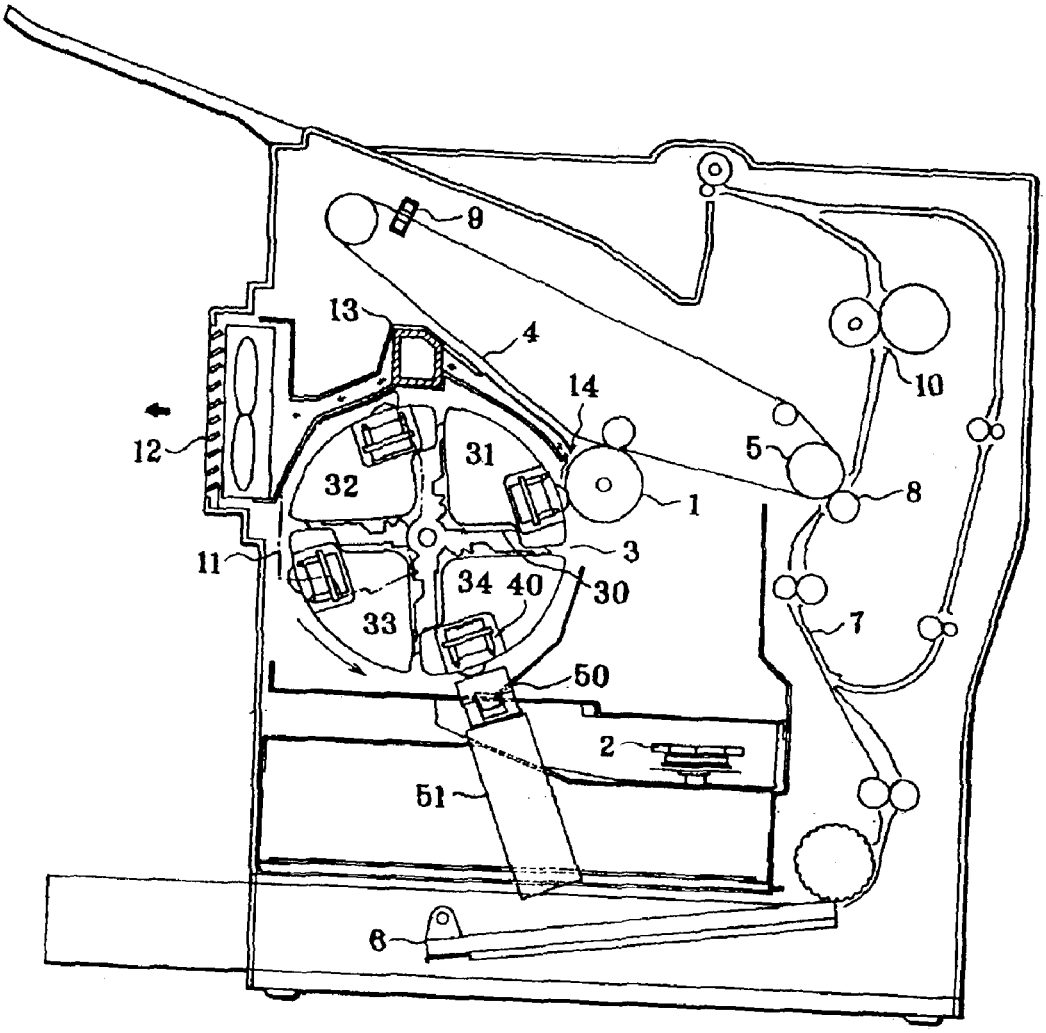
FIG. 1 is an illustration for explaining an image forming apparatus of the present invention, FIGS. 2(*a*)–2(*c*) are illustrations for explaining the position for the replacement of a development cartridge, the position for reading/writing data of a memory IC, and the position for development standby, respectively, FIGS. 3(*a*), 3(*b*) are illustrations for connection and separation between connectors for a memory IC.

FIG. 1 is an illustration for explaining an example of an image forming apparatus according to this embodiment. After charged by a charging unit (not shown), a photoreceptor 1 is subjected to image exposure by an exposure unit 2, thereby forming an electrostatic latent image thereon. Thus formed electrostatic latent images are sequentially developed with four color toners, respectively. The color toners are supplied from development rollers of development cartridges 31 through 34 placed in a rotary frame 30 of a rotary development unit 3, respectively. A transfer belt 4 to be driven by a transfer belt driving roller 5 is arranged to face the photoreceptor 1 at a primary transfer position. The toner images of the respective color toners are primarily transferred to the transfer belt 4 and superposed on each other on the transfer belt 4.

On the other hand, a paper sheet taken from a sheet cassette 6 is fed through a feeding passage 7 to a secondary transfer position between the transfer belt driving roller 5 and a transfer roller 8 where the four toner images are transferred to the paper sheet at once. Here, the top of the image on the transfer belt 4 is detected by a belt position detection sensor 9. The control is conducted so that the top of the image and the top of the paper sheet are met. The image secondarily transferred to the paper sheet is fixed by a fixing unit 10. In case of double-side printing, the paper sheet is returned to the feeding passage 7 and an image is transferred to the verso of the paper sheet. After transferred and fixed, the paper sheet is discharged outside the apparatus.

Each of the development cartridges 31 through 34 for four colors of the rotary development unit 3 has a connector 40 with a built-in memory IC (hereinafter, sometimes referred to as "memory IC-integrated connector") (as will be described later in detail) mounted therein. According to this structure, a body-side connector 50 can read/write data. The body-side connector 50 is driven by a driving member 51 with a motor to move ahead to its advance position and moves astern to its resting position. When the cartridge is replaced with new one, the body-side connector 50 moves ahead to the advance position where the body-side connector 50 is electrically connected to the connector 40 to read/write the data of the memory IC. Normally, the body-side connector 50 is in the resting position. Each development cartridge can be removed and attached to the apparatus at a position corresponding to a cartridge-replacement opening 11 formed in the apparatus body. The image forming apparatus is provided with an exhaust duct 12. Scattered toner particles and other dust are sucked through a suction port 14 near a development nip where the development roller and the photoreceptor are in contact. After filtered by a filter 13, the sucked air is exhausted through the exhaust duct 12. In this case, the position where the memory IC-integrated connector 40 and the body-side connector 50 are connected is arranged on the upstream side than the development nip in the rotational direction of the development unit, thereby preventing the connecting portion between the connectors from being affected by scattered toner particles.

Figure 2A:
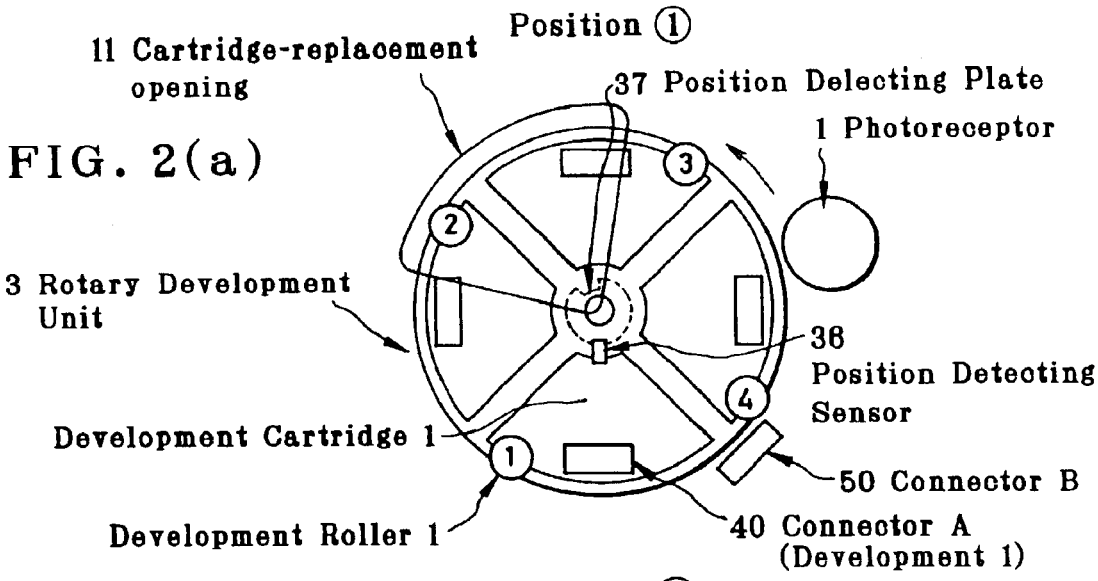
Figure 2B:
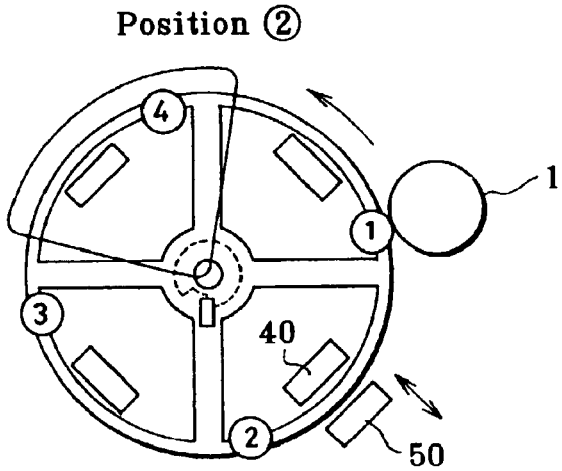
Figure 2C:
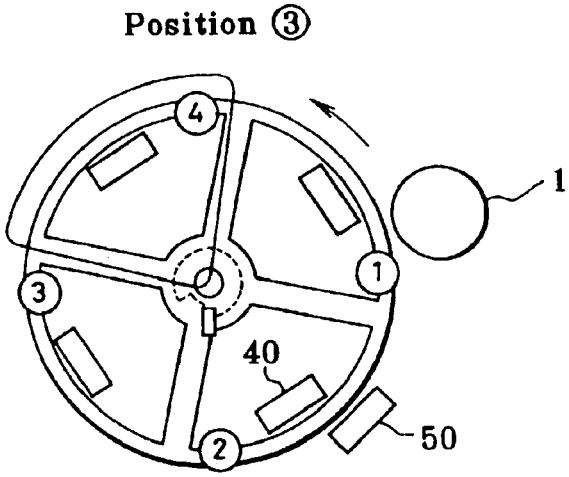

FIGS. 2(*a*)–2(*c*) are illustrations for explaining the position for the replacement of the development cartridge, the position for reading/writing data of the memory IC, and the position for development standby. The home position of the rotary development unit is detected by a position detecting plate 37 and a position detecting sensor 36 wherein the position detecting sensor 36 senses a cutout position of the position detecting plate 37.

FIG. 2(*a*) is an illustration for explaining the cartridge replacement position (Position ①). As mentioned above, the cartridge-replacement opening 11 is formed in the apparatus body. The development rollers ① through ④ of the rotary development unit 3 can be replaced at the position corresponding to the cartridge-replacement opening 11. In this position ①, any of the connectors 40 of the development cartridges does not face the body-side connector 50 and the photoreceptor 1 does not face any of development roller.

FIG. 2(*b*) shows the position where data is read/written from/to the memory IC and the development roller faces the photoreceptor so as to conduct development (Position ②). As a reading/writing command is outputted from the apparatus body side, the positional relation of Position ② is satisfied and the body-side connector 50 is activated to connect the connector 40, thereby reading/writing data.

FIG. 2(*c*) shows a position on the way of switching the development operation by the rotary development unit from one color to another color (Position ③). In this position, the photoreceptor and any development roller do not face each other.

Figure 3A:
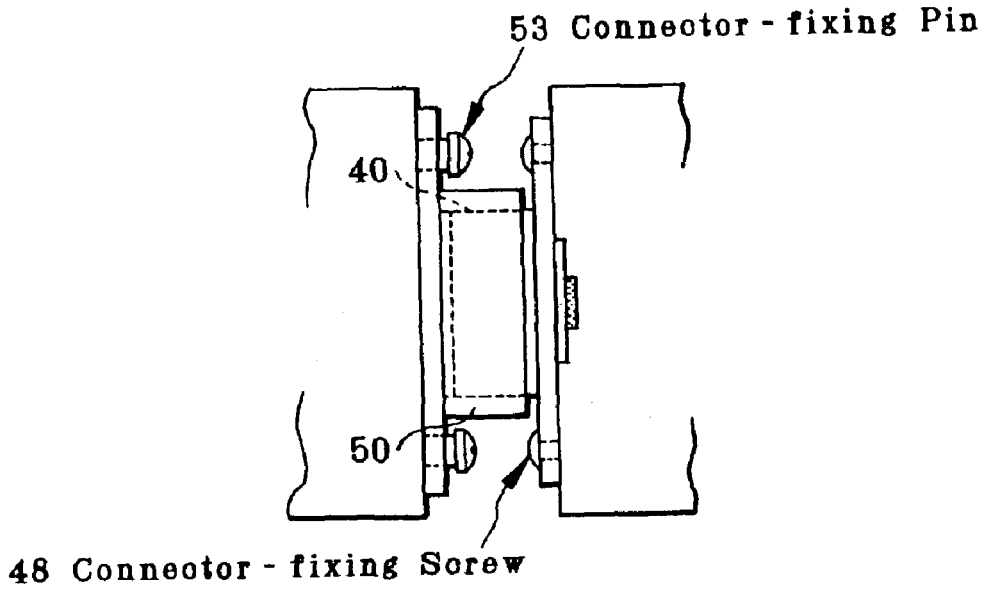
Figure 3B:
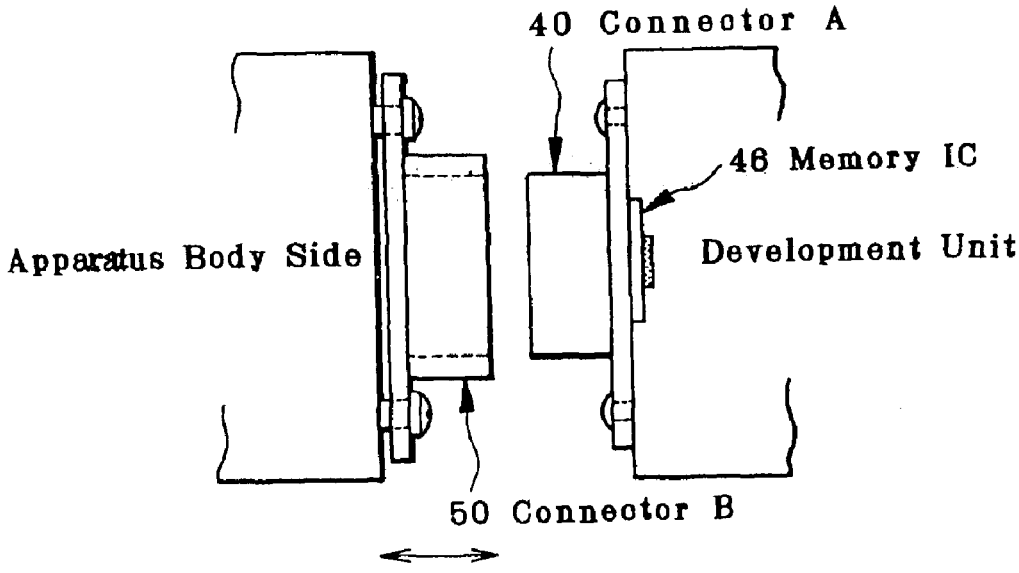

FIGS. 3(*a*), 3(*b*) are illustrations for connection and separation between the connectors.

As shown in FIG. 3(*a*), for connection, the body-side connector 50 is moved ahead to the advance position by a motor. As will be described later, the body-side connector 50 is guided by guiding members of the memory IC-integrated connector 40 and is therefore plugged with the memory IC-integrated connector 40. The connectors are electrically connected by sliding contact between terminals thereof. For separation, the connector 50 is moved astern to the resting position so that the connectors 40 and 50 are separated. The connector 40 is fixed to the development unit by connector-fixing screws 48 and the connector 50 is fixed to the apparatus body by connector-fixing pins 53.

Figure 4:
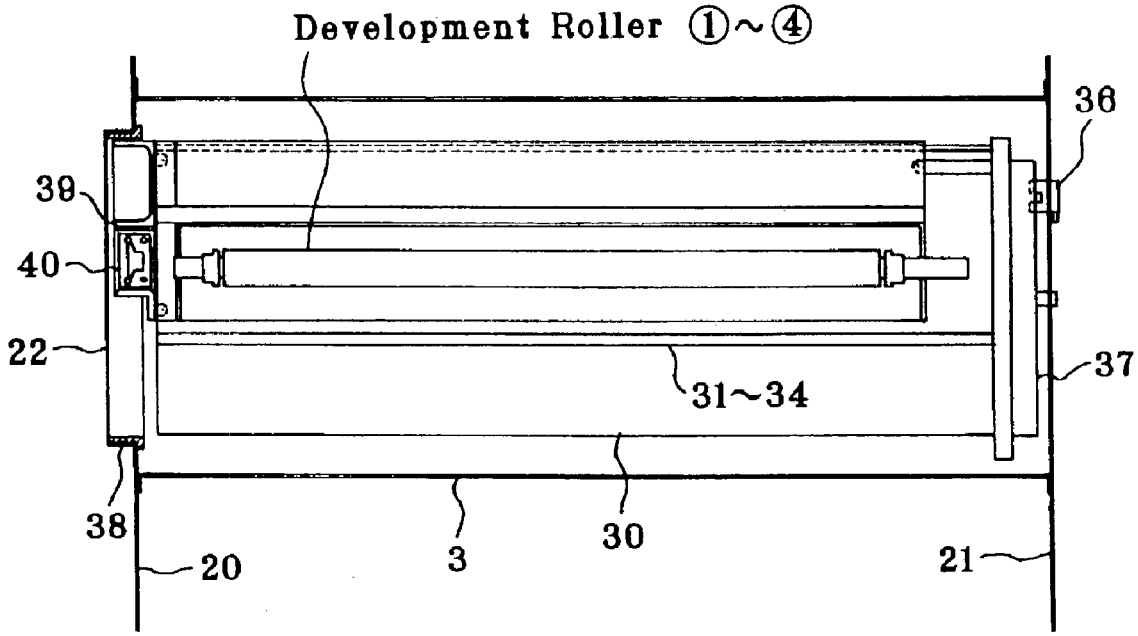
FIG. 4 is an illustration for explaining a rotary development unit, FIGS. 5(*a*)–5(*c*) are illustrations for explaining a connector with a built-in memory IC.

FIG. 4 is an illustration for explaining the rotary development unit.

The rotary development unit 3 is fixed to side plates 20, 21 which are sheet metal. The development cartridges 31 through 34 placed in the rotary frame 30. Each memory IC-integrated connector 40 is fixed to the end of each development cartridge 31–34. In this embodiment, the side plate 21 is a driven side and the side plate 20 is a non-driven side. To prevent the memory IC-integrated connector 40 from being affected by heat of the driving means, the memory IC-integrated connector 40 is fixed to a connector cover 39 received in a receiving portion 22 which is formed by drawing the side plate 20 of the non-driven side. The receiving portion 22 surrounds the connector 40 except a surface facing the body-side connector 50 and thus functions as a shield for preventing the connector 40 from being affected by voltage applied to the development roller. The memory IC-integrated connector 40 is covered by a connector cover 39 and an IC protective member 38 composed of a resin ring is arranged on the inner surface of the receiving portion so as to prevent the memory IC from being affected by static electricity from the sheet metal forming the receiving portion.

Figure 5A:
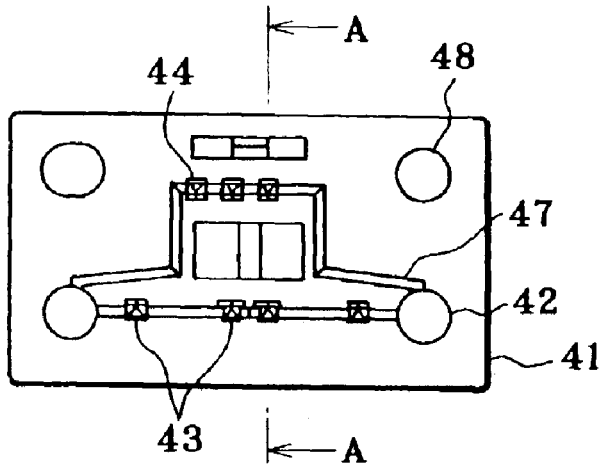
Figure 5B:
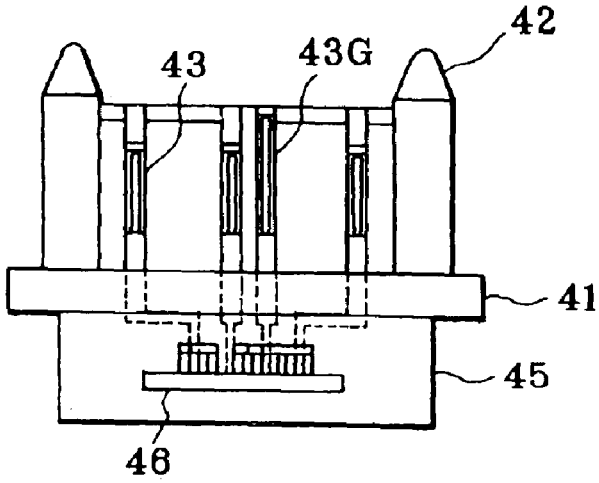
Figure 5C:
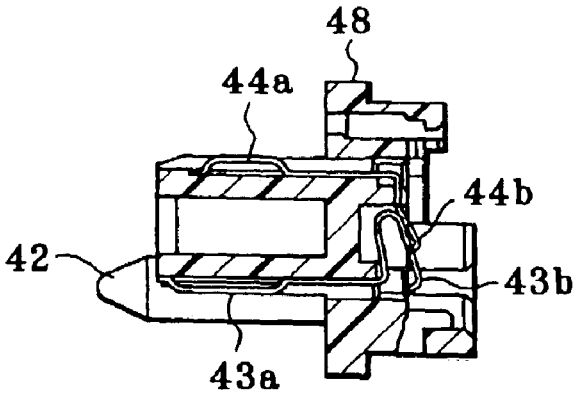
Figure 6:
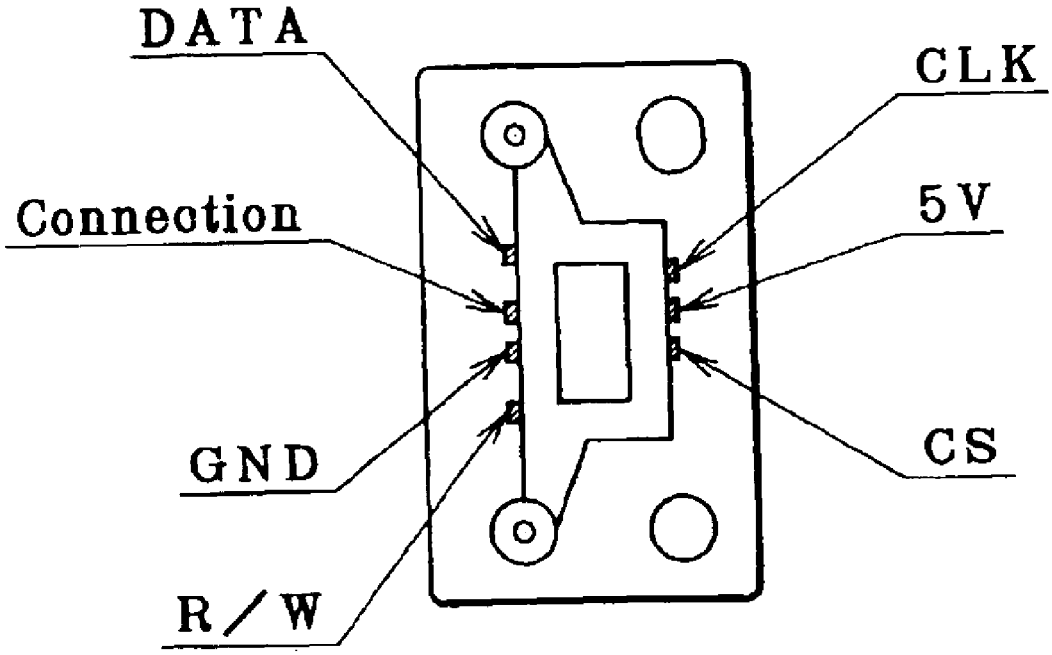
FIG. 6 is an illustration for explaining a connector terminal, FIGS. 7(*a*), 7(*b*) are illustrations for explaining the installation of a memory IC substrate into a connector body.

FIGS. 5(*a*)–5(*c*) are illustrations for explaining the memory IC-integrated connector of the embodiment, wherein FIG. 5(*a*) is a plan view thereof, FIG. 5(*b*) is a front view thereof, and FIG. 5(*c*) is a sectional view taken along a line A—A of FIG. 5(*a*). The memory IC-integrated connector 40 comprises a base 41 as a member for receiving impact produced during connection, and two guide members 42 which are disposed to stand on one surface (surface to be connected to the body-side connector) of the base 41 at both end portions near edges of the base 41. Disposed on the other surface (back surface) of the base 41 is a contact protecting member 45 encompassing a memory IC substrate 46. The base 41, the guide members 42, and the memory IC substrate 46 are integrally formed as a chassis 47. In addition, contact members 43, 44 are disposed integrally with the guide members 42 at locations between the guide members 42 to stand in parallel with the guide members 42, respectively. The reason why the guide members 42 are arranged outside the contact members is that the guide members 42 of the connector 40 is encompassed by the body-side connector so as to improve the stability of connection between the connector 40 and the body-side connector during the connecting operation and to stabilize the contact state of contacts.

In this embodiment, four contact members 43 are aligned in a line at the front side (far from the end of the development roller) and three contact members 44 are aligned in a line at the rear side (near the end of the development roller) of the chassis 47, that is, the contact members are aligned in two lines and thus being compact as a whole. Of cause, the contact members are not limited to be aligned in two lines and may be aligned in a line or three lines. The terminals of the four contact members 43 at the front side are a data terminal, a connection detecting terminal, a ground (GND) terminal, and a data reading/writing terminal, while the terminals of the three contact members 44 at the rear side are a clock terminal, a power source terminal, and a chip select (CS) terminal.

The contact members 43, 44 comprise contact terminals 43*a*, 44*a* to which terminals of the body-side connector are connected by sliding contact each other. The contact members 43, 44 have spring contact terminals 43*b*, 44*b* extending through through holes formed in the base 41 to the back side of the base 41. The spring contact terminals 43*b*, 44*b* are arranged to come in elastically contact with terminals of the memory IC substrate 46. When the memory IC substrate 46 is mounted to the contact protecting member 45, the spring contact terminals 43*b*, 44*b* come in elastically contact with the terminals of the memory IC substrate 46. The memory IC substrate 46 is pressed against a mounting surface of the contact protecting member 45 by spring force of the contact terminals 43*b*, 44*b* so that the memory IC substrate 46 is spaced apart from the base 41. When the body-side connector 50 is driven by the motor to move ahead to its advance position and thus come in contact with the connector 40, the terminals 43*a*, 44*a* of the contact members 43, 44 are slid to and come in contact with the terminals of the body-side connector and the impact produced by the contact is received by the base 41. However, since the memory IC substrate 46 is spaced apart from the base 41, the impact is not directly transmitted to the contact portions between the terminals of the memory IC substrate 46 and the contacts 43*b*, 44*b*.

The connector 40 is structured to have the sliding contacts to be connected to the body-side connector on one side of the base 41 as impact receiving member and the fixed contacts to be connected to the memory IC substrate supported by floating construction to have a space relative to the back side of the base 41. Therefore, the impact, produced when the body-side connector is connected, is received by the base 41 and is not transmitted to the memory IC substrate, thereby keeping the stable contacts relative to the memory IC substrate.

The double-contact structure composed of the contacts relative to the memory IC substrate and the contacts relative to the body-side connector achieves the arrangement of preventing the impact, produced when the body-side connector is connected, from being directly transmitted to the memory IC substrate so as to stabilize the contacts relative to the memory IC substrate, and achieves the contacts relative to the body-side connector while sliding the terminals so as to refresh the contacts, improving the reliability of the contacts.

Because of the triple structure composed of a guiding portion, an impact receiving portion, and a contact protecting portion, the connection relative to the body-side connector is conducted by the guiding portion, the impact produced during the connection is received by the impact receiving portion, and the memory IC substrate is encompassed by the contact protecting member (portion), thereby ensuring the stability of the contacts. In addition, since the terminals relative to the body-side connector are slid to the corresponding terminals, the contacts thereof can be refreshed, thereby improving the reliability. Since the guide portion is arranged outside the terminals of the contacts relative to the connector, the insertion is stabilized, thereby ensuring the stability of the contacts of the terminals.

In order to protect the memory IC substrate to be mounted to the connector from inferior contact due to toner stains and from destruction of data due to effect of static electricity, it is preferable that the contacts of the memory IC substrate are located not to be directly exposed to outside. In this embodiment, the memory IC substrate is surrounded by the contact protecting member 45 and is supported by the spring contacts inside the contact protecting member 45.

Among the seven contact members shown in FIG. 5, the four contact members aligned with the guide members 42 in a line are located at a far side relative to the development roller (at the front side) and the balance i.e. the three contact members are located at the development roller side. Among the four contact members at the front side, the contact member 43G as a ground terminal is the longest so that the contact member 43G first touches the body-side connector during the connection.

At the time of development, a voltage of 2 KVp-p is applied to the development roller. The contact members are susceptible to field noise due to the effect of the applied voltage. The longest contact member is particularly susceptible to field noise because it serves as an antenna. Accordingly, in this embodiment, the ground terminal 43G is arranged at farthest from the development roller. Of cause, long terminals other than the ground terminal are preferably located outside.

Figure 7A:
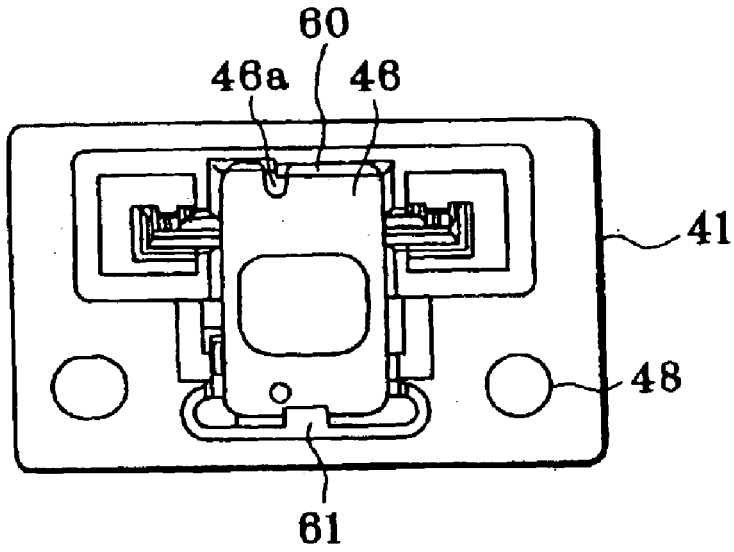
Figure 7B:
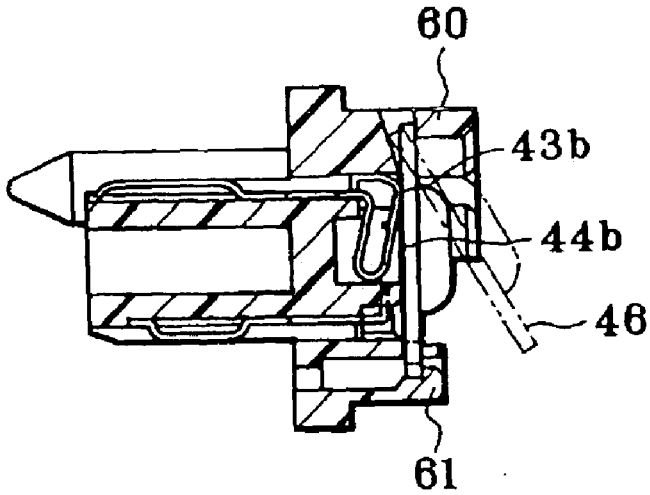

FIGS. 7(*a*), 7(*b*) are illustrations for explaining the installation of the memory IC substrate into the connector body.

FIG. 7(*a*) is an illustration showing the installed state of the memory IC substrate as seen from the back side of the connector. The memory IC substrate 46 is provided at a position slightly off the center thereof with a cutout 46*a*. The front ends on the both sides of the cutout 46*a* have different extension length. The connector body is formed with a positioning mount portion 60 having depressions of which depths are different corresponding to the both sides of the substrate. Therefore, when a user tries to insert the front ends of the substrate into the positioning mount portion 60 in the wrong way, the insertion should be unworkable. That is, the arrangement can prevent the mistaken insertion. On the other hand, the rear end of the substrate is arranged to engage a hook portion 61 of the connector body.

FIG. 7(*b*) is a sectional view for explaining the installation of the memory IC substrate. The memory IC substrate 46 is made of elastic resin. The front ends of the substrate are inserted into the positioning mount portion 60. The substrate is pressed against the connector body by the pivotal movement and is warped by utilizing its elasticity so that the rear end of the substrate engages the hook portion 61. At this point, the terminals of the memory IC substrate are in elastic contact with the spring contact terminals 43*b*, 44*b*, so that the memory IC substrate is pressed against the positioning mount portion 60 and the hook portion 61 because of the spring force of the contacts, thereby stabilizing the installation and stabilizing the contact state. Therefore, the inferior setting due to external force or the like may never be cause, thereby achieving the simplification of the terminal structure and thus improving the reliability of contacts.

Further, since the memory IC substrate is made of a material having elasticity, the memory IC substrate is elastically and detachably installed to the connector body, thereby improving the assembility and applying reusability to the memory IC substrate. Since the terminals are aligned in a plurality of lines, smaller connector can be achieved. In addition, since the cutout for positioning is formed in the memory IC substrate, mistake insertion of the substrate can be prevented.

For reusing the memory IC substrate, in case that the memory IC substrate is fixed by soldering or the like such as in an inkjet printer, the IC itself should be heated for unsoldering during the operation removing the memory IC so that information stored in the memory may be broken. On the other hand, for reading out information stored in the memory without detaching the memory IC, terminals must be brought in contact with the memory IC attached to a narrow space of a large apparatus such as an electrophotographic apparatus which is larger than inkjet printers. This operation is extremely complex.

In this embodiment, however, since the spring contact members make contact relative to the terminals of the memory IC substrate, the memory IC is detachable. Even though the connector body is fixed, the memory IC can be easily removed and collected so that information stored therein can be read out and reused.

Figure 8:
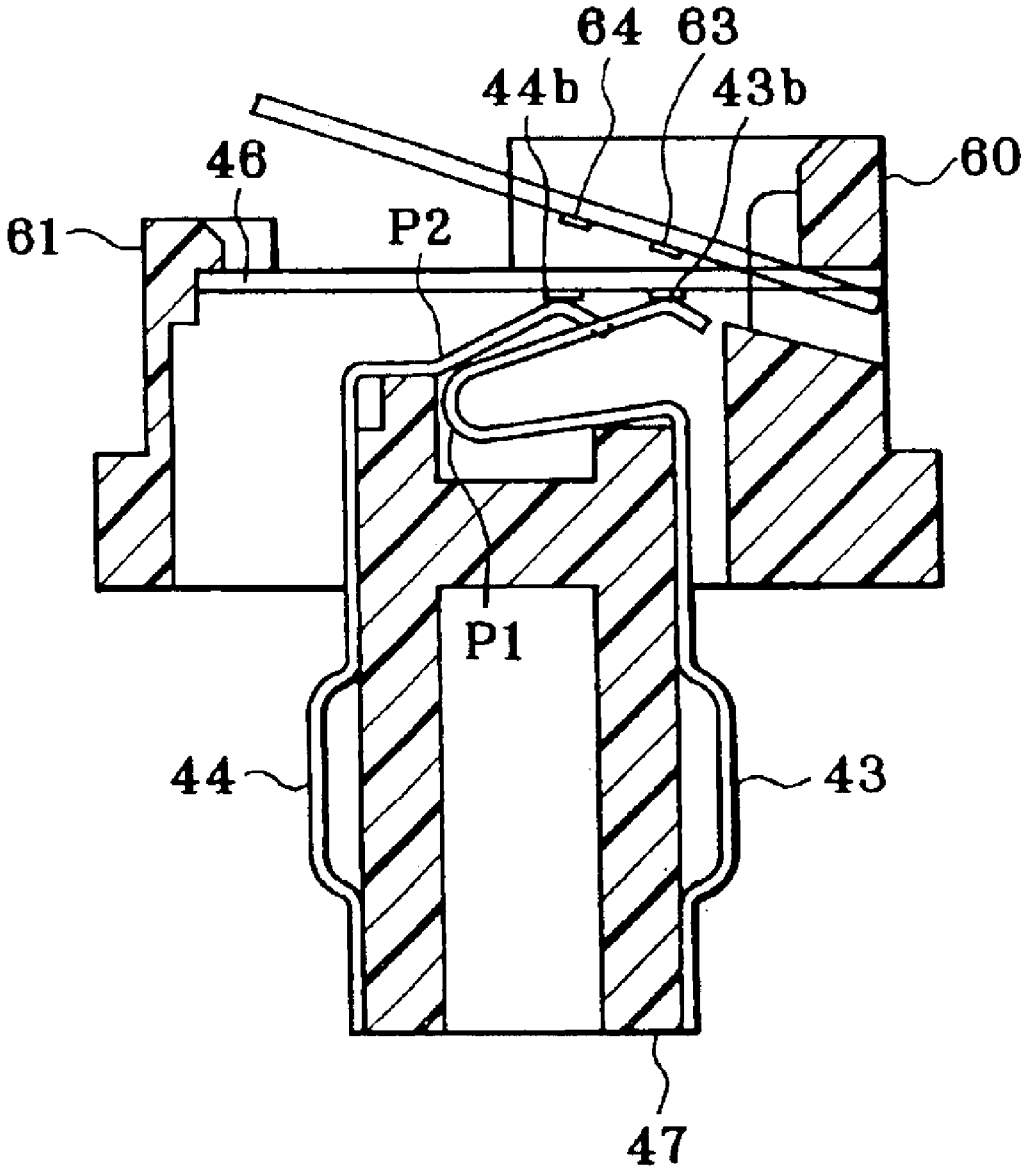
FIG. 8 is a sectional view showing the main parts of the connector into which the memory IC substrate is installed.

FIG. 8 is a sectional view showing the main parts of the connector into which the memory IC substrate is installed.

The contact members 43, 44 are formed on both sides of the chassis 47 of the connector 40 and extend over the back side of the connector body. The extending portions of the contact members 43, 44 are bent to obtain elasticity so as to form contacts 43*b*, 44*b*, respectively. The connector body is provided with the positioning mount portion 60 and the hook portion 61 as mentioned above. As mentioned above, the end of the memory IC substrate 46 with the cutout is inserted into depressions of the positioning mount portion 60 and the substrate 46 is pressed against the connector body so that the other end engages the hook portion 61, that is, the installation is carried out by utilizing the elasticity of the substrate. During this, the terminals, 63, 64 of the memory IC substrate come in contact with the contacts 43*b*, 44*b* of the connector side to form fixed contacts.

In this embodiment, the terminals of the memory IC substrate are terminals 63, 64 in two lines at the positioning mount portion 60 side relative to the center thereof. For locating the spring supporting points P1, P2 farthest from the terminals 63, 64, the spring supporting points P1, P2 are located near the hook portion 61. According to this structure, the terminals 63, 64 come in softly contact with the contacts 43*b*, 44*b* by the spring force during the installation of the memory IC substrate, thereby obtaining suitable contacting force.

Since the spring supporting points P1, P2 are located at substantially the same position, the length from the spring supporting point to the contact 43*b* is longer than the length from the spring supporting point to the contact 44*b*. Accordingly, the force of the contacts 43*b* is smaller than the force of the contact 44*b* because these are made of the same material. The installation of the memory IC substrate is carried out by inserting the end near the terminals 63, 64 into the depressions of the positioning mount portion 60 and pressing the substrate to force the other end to engage the hook portion as shown in FIG. 8. Therefore, the force of the contact 43*b*, which first comes into contact, is set to be smaller than that of the contact 44*b*, thereby facilitating the installation and stabilizing the installation. Because the installation can be done with weak force, the memory IC substrate is hardly damaged and is therefore reuseable.

As described above with regard to FIG. 5, the contact member 43 is composed of four contacts and the contact member 44 is composed of three contacts. In case of that the contacts are aligned in a plurality of lines (two in this embodiment) and the lines are different from each other in the number of contacts as mentioned above, the contacts of the larger number side (the contact 43*b* with lower spring load) are positioned at the positioning mount portion side, thereby minimizing the force required for installation, facilitating the installation, and stabilizing the installation. In addition, because the installation can be done with weak force, the memory IC substrate is hardly damaged and is therefore reuseable.

In case that the number of the contacts with lower spring load is different from the number of the contacts with higher spring load, the number of the contacts with lower spring load is set to be larger. Even with larger number of contacts, no problem occurs because of the lower spring load. Since the force at the contact is determined by spring pressure, the terminal is not affected even with larger number of contacts.

When the contacts of the larger number side (the contact 43*b* with lower spring load) are positioned on the positioning mount portion side, the contact 44*b* with higher spring load and having relatively larger contact force is positioned near the center of the memory IC substrate, thereby increasing the spring contact pressure at the center when the memory IC substrate is installed. Because the spring contact pressure at the center is increased, the substrate is pressed from the center thereof so that pressure is equally applied to the positioning mount portion side and the hook portion side, thereby achieving the stable mounting. The mounted state of the substrate is stabilized.

As mentioned above, in case that terminals are arranged in a plurality of lines which are different in spring load by setting the spring load of contacts at the center of the substrate to be higher than that of the other contacts of the other portion, pressure is equally applied to the positioning mount portion side and the hook portion side, thereby offering advantages of stabilizing the mounted state of the substrate.

We claim:

1. A connector with a built-in memory IC which is mounted in a rotary development unit and of which data is read and written by bringing an apparatus body-side connector in contact with said connector, comprising: a plurality of contact members; a guide member(s) which is formed integrally with the contact members for guiding the movement of the apparatus body-side connector; an impact receiving member being provided on one surface thereof with said guide member; and a contact protecting member which is disposed on the other surface of the impact receiving member and encompasses a memory IC substrate.

2. A connector as claimed in claim 1, wherein said guide member is formed outside of the contact members.

3. A connector as claimed in claim 1, wherein said contact members have contacts of which electric connect is achieved by sliding with terminals of the apparatus body-side connector, and wherein conductive members extending from said contact members through the impact receiving member are elastically in contact with terminals of the memory IC substrate by spring force so as to form fixed contacts.

4. A development cartridge having a connector, as claimed in claim 1, 2, or 3, which is fixed to an end thereof.

5. An image forming apparatus having a development cartridge as claimed in claim 4.

6. A connector to which a memory IC substrate is detachably attached and which comprises conductive members having connecting terminal relative to an apparatus body-side connector and connecting terminals relative to the memory IC substrate, wherein the connecting terminals of said conductive members relative to the memory IC substrate have elasticity, wherein the front end of said memory IC substrate is inserted into a mount portion of the connector body and the rear end of said memory IC substrate engages a hook portion of the connector body by utilizing the elasticity of the memory IC substrate, thereby installing the memory IC substrate to the connector body.

7. A connector as claimed in claim 6, wherein said memory IC substrate has a cutout which is formed in the front end thereof to be inserted into the mount portion of the connector body at a position slightly off the center thereof.

8. A connector as claimed in claim 6 or 7, wherein the line of the connecting terminals of a plurality of current carrying elements relative to the memory IC substrate is aligned with the line of the terminals of the memory IC substrate.

9. A connector comprising a positioning mount portion which is engaged with a front end of a memory IC substrate and a hook portion for engaging a rear end of the memory IC substrate and having contacts which are in contact with terminals of the memory IC substrate by spring force in the state that the memory IC substrate is detachably installed to the connector, wherein said contacts are aligned in a plurality of lines and, among said contacts, a contact at the center side of a substrate is set to have a spring load higher than the other contacts.

10. A connector as claimed in claim 9, wherein said contacts are aligned in two lines, the contacts in the first line have lower spring load and are located at the positioning mount portion side, and the contacts in the second line have higher spring load and are located at the center side of the substrate.

11. A development cartridge having a connector, as claimed in claim 9 or 10, which is fixed to an end thereof.

12. An image forming apparatus having a development cartridge as claimed in claim 11.

* * * * *